US006692225B2

(12) United States Patent
Lin

(10) Patent No.: US 6,692,225 B2
(45) Date of Patent: Feb. 17, 2004

(54) LIQUID PRESSING DEVICE

(76) Inventor: Po Hung Lin, No. 6, Lane 255, Sec. 2, Meitsuen Rd., Taichung (TW)

( * ) Notice: Subject to any disclaimer, the term of this patent is extended or adjusted under 35 U.S.C. 154(b) by 120 days.

(21) Appl. No.: 10/093,499

(22) Filed: Mar. 11, 2002

(65) Prior Publication Data

US 2003/0167937 A1 Sep. 11, 2003

(51) Int. Cl.[7] ..... F01D 5/00

(52) U.S. Cl. ..... 415/72; 415/221; 417/423.3; 417/366; 440/38; 114/55.56

(58) Field of Search ..... 415/72, 73, 75, 415/221; 416/176, 177; 417/423.1, 423.3, 423.14, 366; 440/38, 40, 41, 42, 43; 114/55.5, 55.56

(56) References Cited

U.S. PATENT DOCUMENTS 5,332,355 A * 7/1994 Lyda, Jr. ..... 415/74

* cited by examiner

*Primary Examiner*—Edward K. Look
*Assistant Examiner*—Kimya N Mccoy
(74) *Attorney, Agent, or Firm*—Troxell Law Office PLLC

(57) ABSTRACT

A liquid pressing device includes mainly a power device consisting of a motor with a spindle, an upper cap on the motor and a lower cap under the motor, a shell for containing the power device, a helical device fitted around the spindle of the motor and having a conical body and a plurality of helical leaves around the conical body. The helical leaves spiral down to form a helical groove between every two helical leaves for water to pass through. The helical leaves have thickness gradually becoming thinner and thinner downward, and the helical grooves gradually become narrower and narrower downward to add pressure to water flowing up therein. Then the conical member functions to add second pressure to water passing through, sending it to a very high location. Then the liquid pressing device can function as a water pump or a propeller.

10 Claims, 5 Drawing Sheets

LIQUID PRESSING DEVICE

BACKGROUND OF THE INVENTION

This invention relates to a liquid pressing device, particularly to one provided with a helical device to produce pressing power to liquid to function as a water pump for sending liquid to a high position or as a propeller for moving a floating board or a boat or the like.

A sunk-in-water pump is generally used in an aquarium to suck water therein into a filter tank for filtering and removing miscellaneous dirty matters off. A pumping motor is used in a high building to pump water up in a water tank positioned on top of the building for use. Whether it is a sunk-in-water pump or a pumping motor, the theory of them is to utilize a motor and a leaf or a gear to force water to move centrifugally so as to produce pressure to water to be sent, and therefore send it to a high position where water is to be used or stored.

However, a conventional centrifugal leaf is a combination of an independent leaf, impossible to maintain its pressure force continually, and if water located at a lower position is to be sent to a high position, it needs a very large force, subsequently increasing cost for manufacture, noise produced, space and weight needed.

SUMMARY OF THE INVENTION

The main purpose of the invention is to offer a liquid pressing device mainly utilizing a helical device having helical leaves for forming helical grooves, which spiral narrower and narrower upward so as to add pressure to water flowing therethrough for sending water to a very high location, functioning as a water pump or a propeller.

Another purpose of the invention is to offer a liquid pressing device utilizing a conical upper cap and a conical tubular member for adding more pressure to water flowing through, functioning to press water twice.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
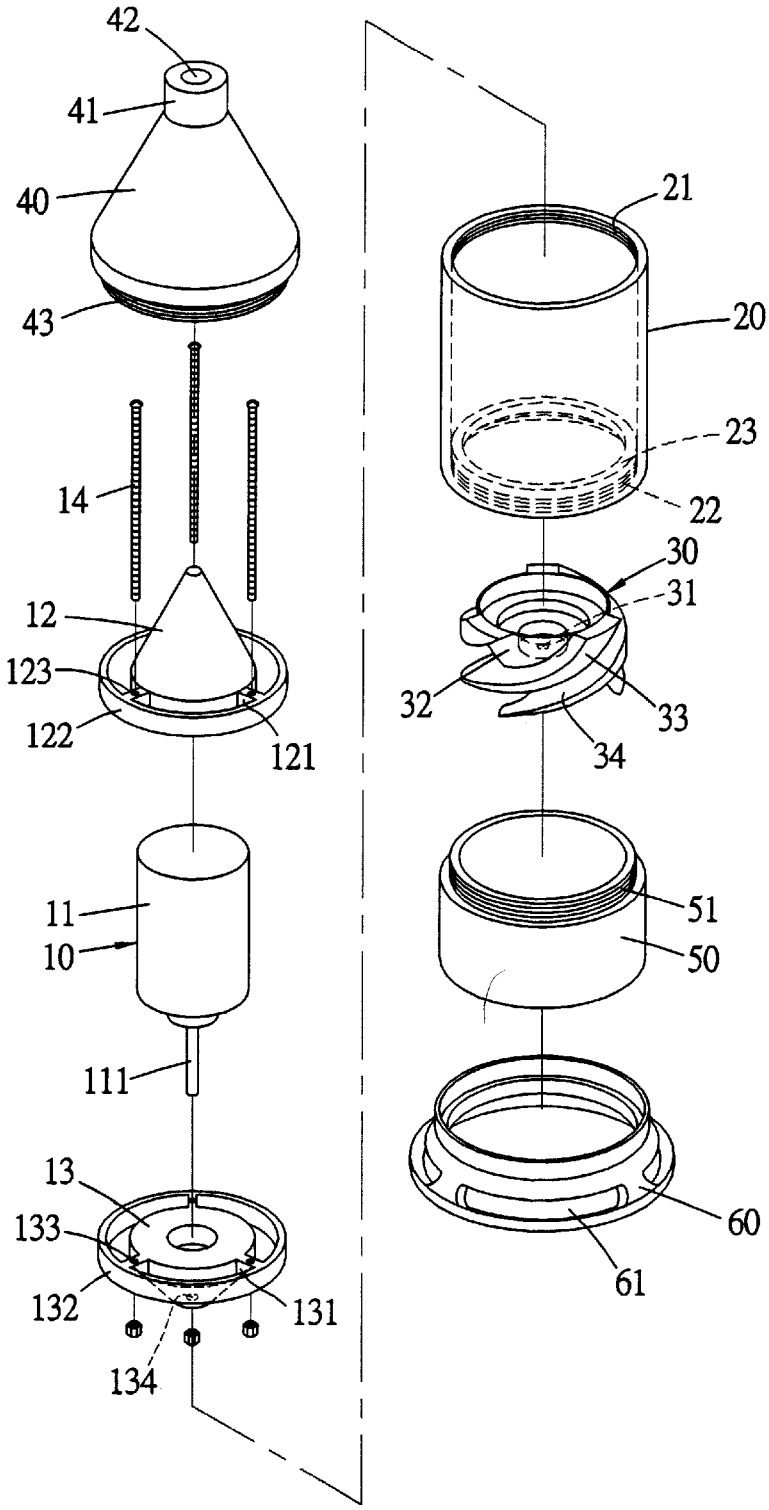
FIG. 1 is an exploded perspective view of a first embodiment of a liquid pressing device in the present invention.
Figure 2:
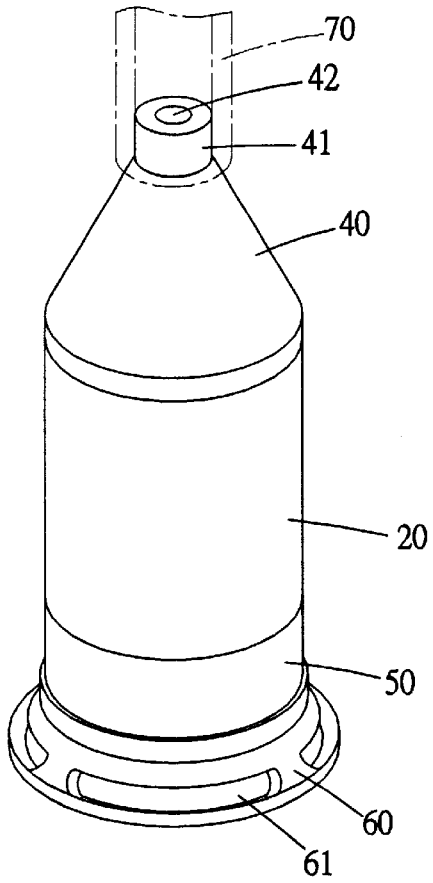
FIG. 2 is a perspective view of the first embodiment of a liquid pressing device in the present invention.

A first embodiment of a liquid pressing device in the present invention, as shown in FIGS. 1 and 2, includes a power device 10, a shell 20, a helical device 30, a conical member 40, a sucking tubular member 50, and a bottom base 60 as main components combined together.

The power device 10 is composed of a motor 11, an upper cap 12, and a lower cap 13. The motor 11 has a spindle 111 extending out of a lower side, and covered on top by the upper cap 12 and on a lower end by the lower cap 13. The upper and the lower cap 12 and 13 have a conical portion, three ribs 121, 131 respectively, an annular wall 122 or 132, a through hole 123 or 133 in the rib 121 or 131, and an elongate bolt 14 screwing through the through hole 123 or 133, keeping the motor 11 between the upper and the lower cap 12 and 13 securely. Further, the lower cap 13 has a center hole 134 for the spindle 111 of the motor 11 to pass through down.

The shell 20 is a hollow tube, having an upper end provided with first female threads 21 and a lower end provided with second female threads and an inner annular projection 23 near the second female threads 22. When the motor 11 is placed in the shell 20 from above downward, it is sustained by the annular inner projections 23, prevented from falling down.

Figure 3:
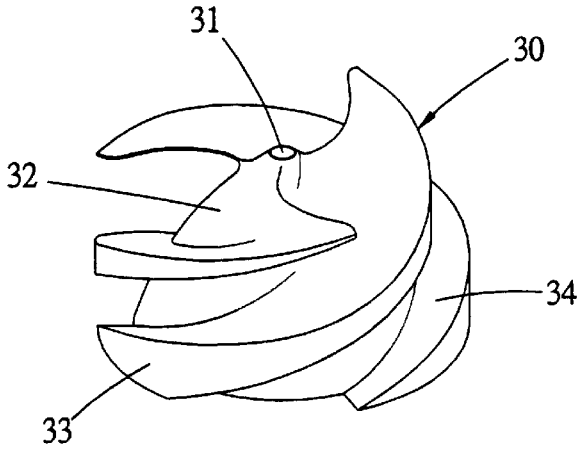
FIG. 3 is a perspective view of a helical device in the present invention.

The helical device 30 has a center hole 31 to fit around the spindle 111 of the motor 11 from under, and rotates together with the motor 11, and a conical body 32 provided integral with a preset number of helical leaves 33 around its outer annular surface, as shown in FIG. 3. The helical leaves 33 spiral down from an upper end to a lower end, with their thickness gradually becoming larger and larger, and a helical groove 34 formed between every two helical leaves and gradually becoming narrower and narrower. Therefore, when liquid moves up through the helical grooves 34, the liquid may be added in its pressure by function of tapering of the helical grooves 34.

The conical member 40 screws tightly with the upper end of the shell 20, tapering upward, having a connect head 41 with a center hole 42 formed in the upper portion and male threads 43 formed in a lower end to screw tightly with the female threads 21 of the shell 20 to combine the conical member 40 with the shell 20.

The sucking tubular member 50 screws tightly with the lower end of the shell 20, having male threads 51 formed in an upper end to engage with the second female threads 22 of the shell 20, combining securely the sucking tubular member 50 with the shell 20, and at the same time the helical device 30 is fitted in the sucking tubular member 50.

The bottom base 60 is fitted for a certain distance in the bottom of the sucking member 50, having a plurality of elongate slots formed spaced apart in a vertical annular wall on a bottom flange for liquid to flow through.

Figure 4:
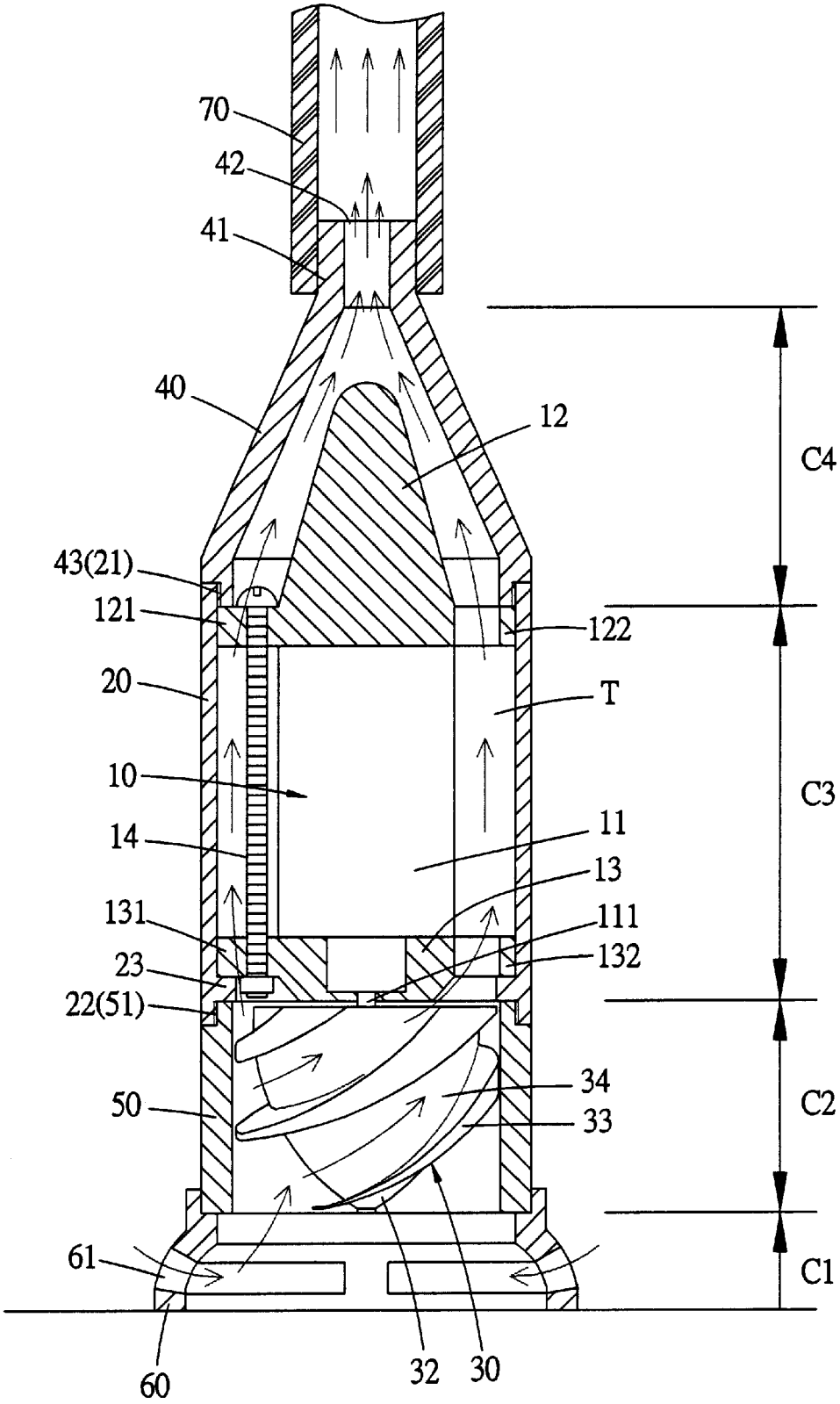
FIG. 4 is a cross-sectional view of the first embodiment of a liquid pressing device and flowing direction of water therein in the present invention.

Next, assembling and function of the components of the liquid pressing device is to be described. As shown in FIGS. 3 and 4, the elongate bolt 14 screw through the holes 123 and 133 of the upper and the lower cap 12 and 13, securing the motor 11 between the upper and the lower cap 12 and 13, forming the power device 10. Then the power device 10 together with the upper and the lower cap 12 and 13 is deposited in the shell 20, with the rib 23 of the shell 20 securing the power device 10. The helical device 30 is located around the spindle 111 of the motor 11, and the conical member 40 screws with the upper end of the shell 20, with the sucking tubular member 50 screwing with the lower end of the shell 20 and with the helical device fitting in the sucking tubular member 50. Lastly, the bottom base 60 is fitted in the lower end of the sucking tubular member 50 to finish assembling of the liquid pressing device in the invention.

In case the liquid pressing device is to be used in an aquarium to suck water into a filter tank, it is placed in the aquarium, with the connect head 41 of the conical member 40 connected with a water tube 70, which extends in the filter tank.

Then the motor 11 is started to rotate the helical device 30, forcing water to flow through the hole 61 in the bottom base 60, which constitutes a sucking division C1. Then water is guided by the helical leaves 33 to move into the helical grooves 34, and water current may gradually become stronger and stronger to form a pressing division C2.

When water current moves between the shell 20 and the power device 10, the space between the shell 20 and the power device 10 may naturally form a water passage T for water to pass through, and at the same time the wall of the shell 20 may disperse heat of water, lowering the heat of the motor 11 at the same time during the water current flowing. Then it forms a cooling division C3. Then water may flow in the conical member 40, and gradually pressed stronger and stronger by means of the upper cap 12 and the conical member 40 to form a pressing division C4. Finally water may flow through the through hole 42 of the connect head 41 into the water tube 70 and then into the filter tank. Thus the liquid pressing device performs liquid pressing.

As can be understood from the above description, the liquid pressing device in the invention has a simple structure, possible to be utilized as a sunk-in-water pump or a water pump to send water to a very high location by mean of twice pressing and helical passages, producing no noise owing to no gears used therein, and occupying small space and weighing light.

Figure 5:
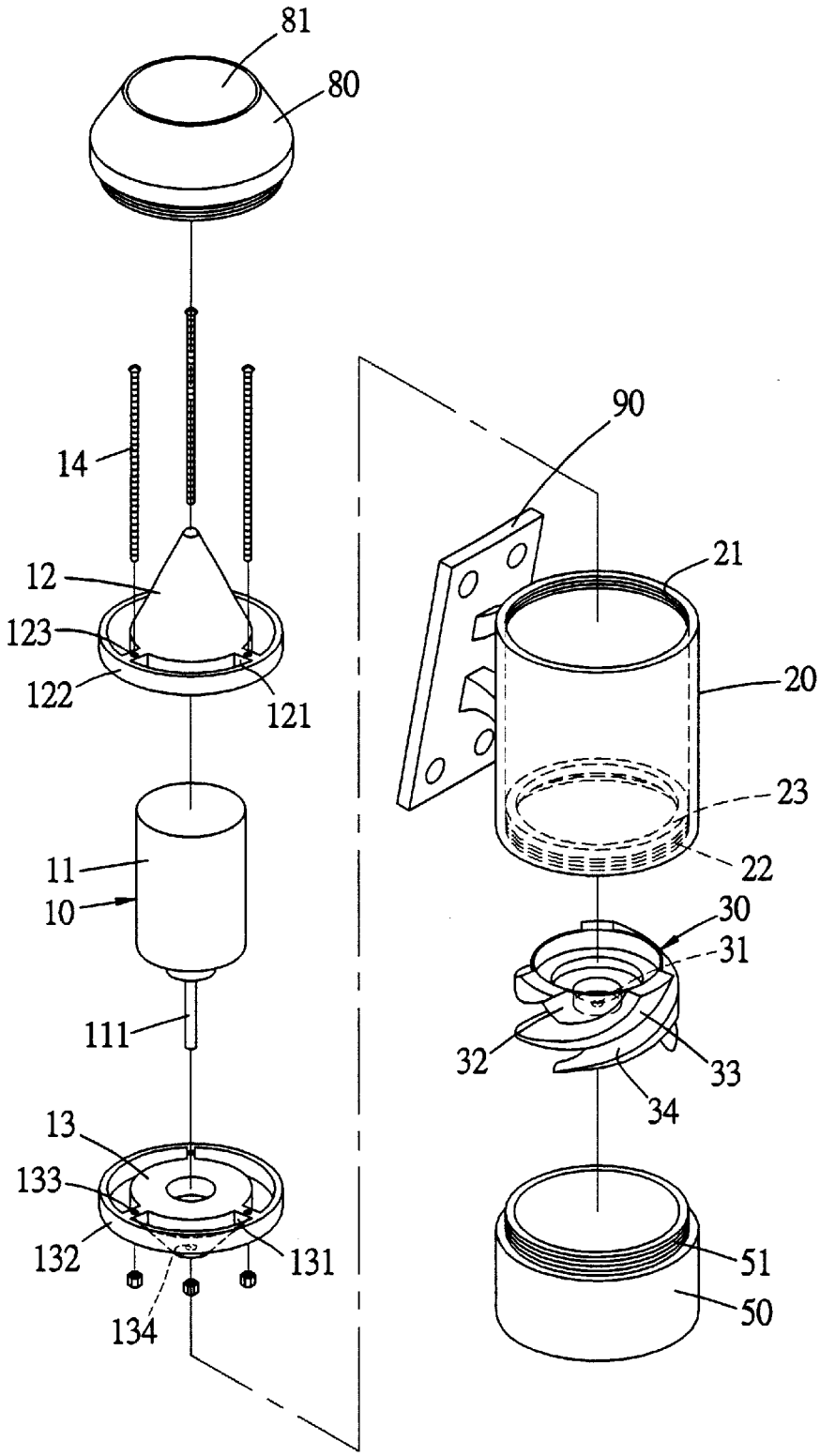
FIG. 5 is an exploded perspective view of a liquid pressing device in the present invention; and, FIG. 6 is a simple view of the second embodiment of a liquid pressing device in the present invention being in use.
Figure 6:
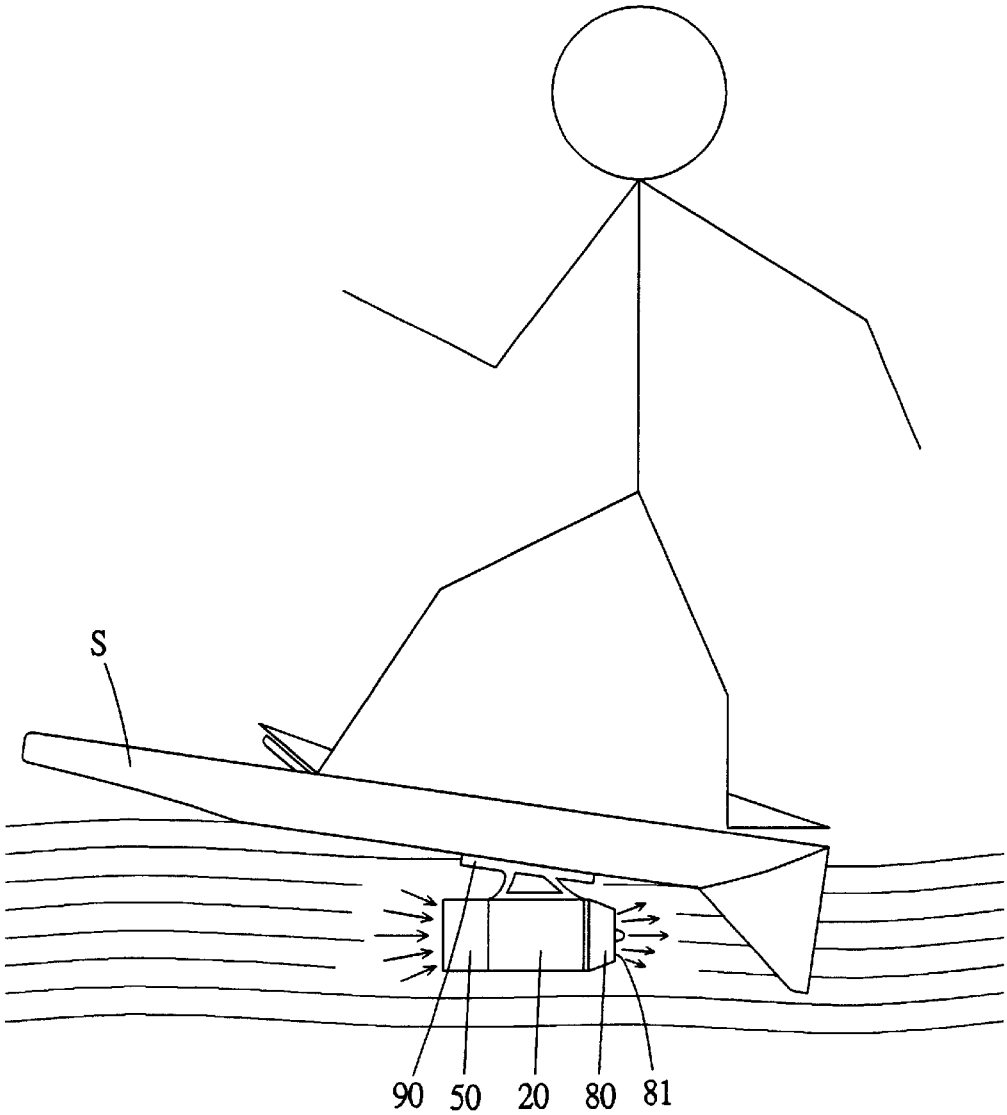

Next, FIGS. 5 and 6 shows a second embodiment of a liquid pressing device in the invention, applied to a float board to function as a propelling device. The second embodiment has removed the bottom base 60 in the first embodiment, and changed the conical member 40 to a conical ring 80 having a round hole 81 in an upper end for water to flow out. Further a connect plate 90 is added to the shell 20, and the connect plate 90 is connected to the float board (S) or the bottom of a boat. Then the float board (S) may be propelled to move swiftly forward by the second embodiment of a liquid pressing device in the invention.

While the preferred embodiments of the liquid pressing device in the invention have been described above, it will be recognized and understood that various modifications may be made therein and the appended claims are intended to cover all such modifications that may fall within the spirit and scope of the invention.

I claim:

1. A liquid pressing device comprising:

a power device composed of a motor having a spindle extending out of a side;

a shell made of a hollow tube, and containing said power device in its hollow interior;

a helical device fitted around the spindle of said motor, rotating together with said motor, having a conical body and a preset number of helical leaves extending around said conical body from an upper end to a lower end, said helical leaves having their thickness gradually becoming thinner and thinner downward, a helical groove formed between every two of said helical leaves and gradually becoming narrower and narrower upward; and, a sucking tubular member fixed at a predetermined location of said shell, and surrounding said helical device.

2. The liquid pressing device as claimed in claim 1, wherein a water passageway is formed between said shell and said power device, and heat of water is dispersed through a circumferential wall of said shell.

3. The liquid pressing device as claimed in claim 1, wherein said conical body and said helical leaves are formed integral.

4. The liquid pressing device as claimed in claim 1, wherein a conical member is provided fixed on an upper end of said shell, tapering upward, having a connect head formed in the upper end and bored with a center hole.

5. The liquid pressing device as claimed in claim 1, wherein an upper cap and a lower cap are provided respectively on and under said motor, having a conical portion, an annular outer wall, three ribs provided spaced apart between said annular outer wall and an inner body, each said rib having a vertical through hole for an elongate bolt to screw through down so as to secure said motor between said upper and said lower cap, said lower cap having a center round hole for the spindle of said motor to pass through.

6. The liquid pressing device as claimed in claim 1, wherein said shell has an upper end provided with first female threads, a lower end provided with second female threads, said conical member having male threads formed in a lower end to engage said first female threads to secure said conical member with said shell, said sucking tubular member having male threads formed in an upper end to engage said second female threads to secure said sucking member in the lower end of said shell.

7. The liquid pressing device as claimed in claim 1, wherein said shell further has an annular inner projection formed in an inner wall of its bottom to sustain the bottom of said power device for preventing said power device from falling down after said power device is placed in said shell.

8. The liquid pressing device as claimed in claim 1, wherein a bottom base is provided under said sucking tubular member, having a plurality of elongate slots spaced apart in a vertical annular wall for water to flow through.

9. The liquid pressing device as claimed in claim 1, wherein a conical ring is further provided tightly on said shell, having a conical shape tapering upward, and a round hole formed in an upper end.

10. The liquid pressing device as claimed in claim 1, wherein a connect board is connected to said shell, and said connect board is then connected under a float board or a bottom of a boat.

* * * * *